United States Patent [19]

Baker

[11] Patent Number: 4,711,202

[45] Date of Patent: Dec. 8, 1987

[54] DIRECT ACTING CAM-VALVE ASSEMBLY

[75] Inventor: Steven F. Baker, Bellevue, Ohio

[73] Assignee: General Motors Corporation, Detroit, Mich.

[21] Appl. No.: 924,826

[22] Filed: Oct. 30, 1986

[51] Int. Cl.[4] ..... F01L 1/30

[52] U.S. Cl. ..... 123/90.26; 123/90.27; 123/90.49; 123/90.55

[58] Field of Search ..... 123/90.24, 90.26, 90.55, 123/20.27, 90.48, 90.49, 90.5

[56] References Cited

U.S. PATENT DOCUMENTS

| | | | |
|---|---|---|---|
| 1,644,059 | 10/1927 | Holle | 123/90.26 |
| 2,858,818 | 11/1958 | Bailey | 123/90.26 |
| 3,090,368 | 5/1963 | Buchwald | 123/90.26 |
| 3,183,901 | 5/1965 | Thuesen | 123/90.27 |
| 3,430,614 | 3/1969 | Meacham | 123/90.27 |
| 3,509,858 | 2/1970 | Scheibe et al. | 123/90.27 |

*Primary Examiner*—Craig R. Feinberg
*Assistant Examiner*—M. Macy
*Attorney, Agent, or Firm*—Arthur N. Krein

[57] ABSTRACT

A direct acting cam-valve assembly for an internal combustion engine having an engine block means defining a port includes an internal/external cam fixed to an engine driven camshaft and a direct acting cam follower having one end thereof driven reciprocably by the internal/external cam to push an associated poppet valve from a closed position to an open position and to pull the valve from the open position to the closed position. A conventional hydraulic lash adjuster is operatively positioned in the cam follower whereby one end of the lash adjuster abuts against the free valve stem end of the valve and a spring is operatively positioned in the opposite end of the cam follower and operatively connected to the valve stem end of the valve whereby to, in effect, operatively connect the valve to the cam follower.

3 Claims, 4 Drawing Figures

DIRECT ACTING CAM-VALVE ASSEMBLY

FIELD OF THE INVENTION

This invention relates to a direct acting cam actuated valve train as used in an internal combustion engine and, in particular to a direct acting cam-valve train assembly.

The desirability of using a direct acting cam actuated valve train using followers engaging a cam in a manner so as to directly affect both valve opening and valve closing without the aid of a conventional valve return spring has previously been recognized as shown, for example, in U.S. Pat. No. 3,183,901 issued May 18, 1965 to Niel C. Thuesen. However, in the arrangement shown in this 3,183,901 patent, any lash adjustment has been accomplished, in effect, by a so-called mechanical lash adjuster.

SUMMARY OF THE INVENTION

The present invention relates to a direct acting cam-valve train assembly having a poppet valve, either intake or exhaust, operatively engaging a conventional hydraulic lash adjuster mounted in a cam follower carrying pairs of roller followers operatively associated with an internal/external type cam fixed to an engine driven camshaft of the engine whereby the internal/external type cam is operative to effect opening of the valve and to pull the valve back toward the closed position, a spring being operatively associated with the poppet valve and cam follower to insure proper poppet valve closure.

It is therefore a primary object of this invention to provide an improved direct acting cam-valve assembly for an internal combustion engine wherein a cam follower is operatively connected to an internal/external type cam on an engine driven camshaft, the cam follower, which is reciprocably guided by a guide bore in the cylinder head of the engine, has a hydraulic lash adjuster operatively mounted therein with the piston end thereof engaging the free stem end of an associate poppet valve, and a spring is mounted in the cam follower so as to operatively engage the poppet valve whereby to assure the closing of the poppet valve and to assure that it will remain closed.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
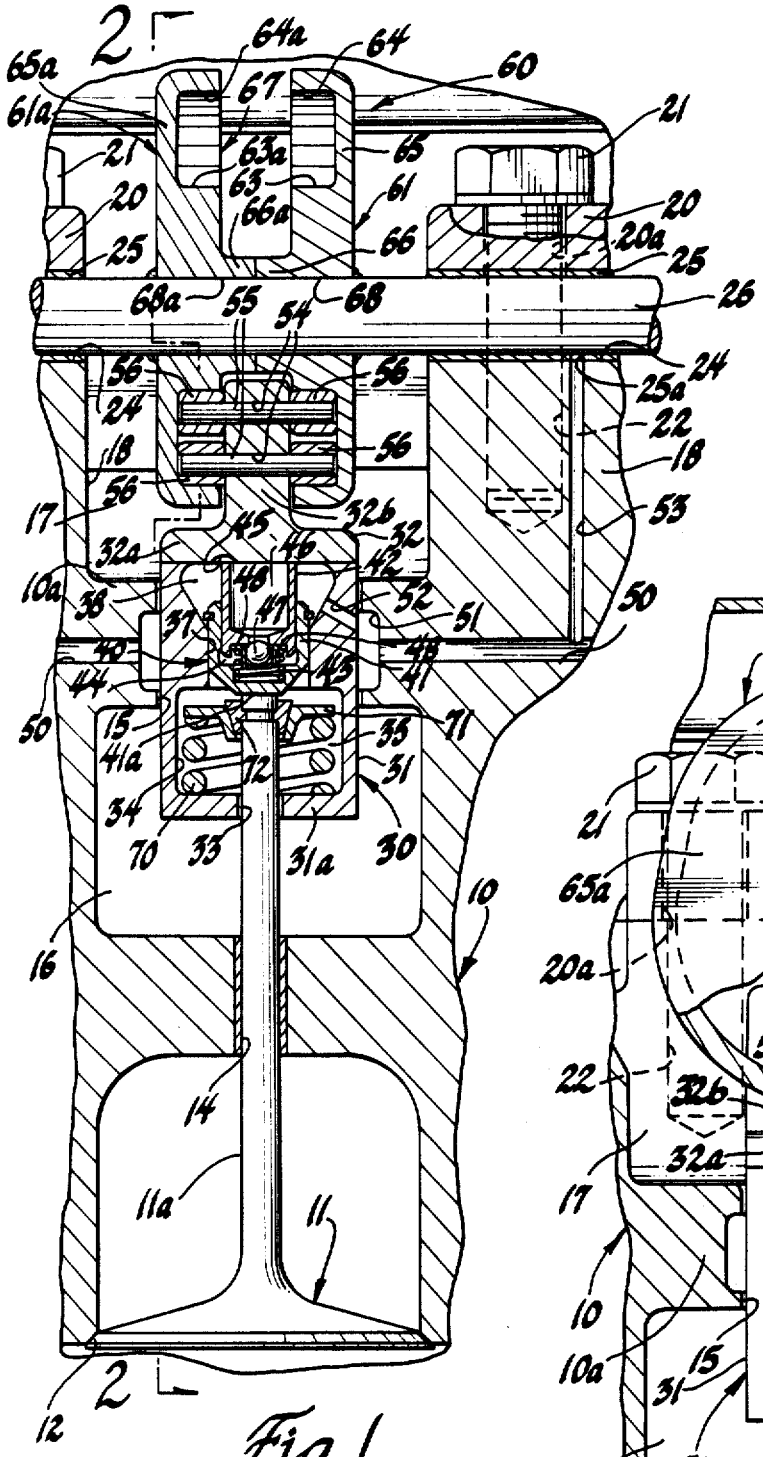
FIG. 1 is a longitudinal cross-sectional view of a portion of an internal combustion engine having a direct acting cam-valve assembly in accordance with the invention incorporated therein, with the elements shown in a valve closed position.

Referring now to the drawings, there is shown a portion of an internal combustion engine having a cylinder head 10, as part of an engine block means, in which a poppet valve 11 (intake or exhaust) is operatively mounted to control flow through a port 12 (intake or exhaust) formed in the cylinder head.

As shown, the stem 11*a* of the poppet valve is guided for axial reciprocation in a valve stem guide bore 14 provided in the lower portion of the cylinder head, while an enlarged diameter follower guide bore 15 is formed in an intermediate web portion 10*a* of the cylinder head concentric with the valve stem guide bore 14 so as to slidably receive a cam follower, generally designated 30, to be described in detail hereinafter.

Figure 2:
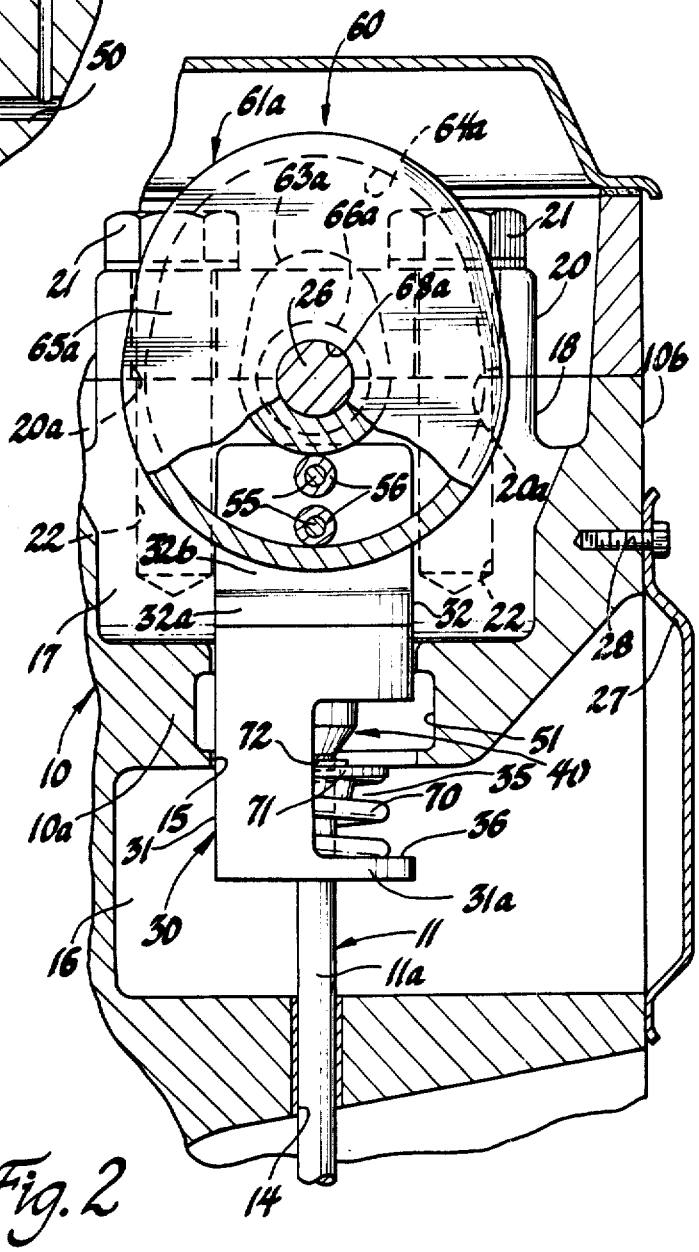
FIG. 2 is a transverse cross-sectional view of the assembly of FIG. 1 taken along line 2—2 of FIG. 1 with the cam follower and a portion of the cam shown in elevation.
Figure 4:
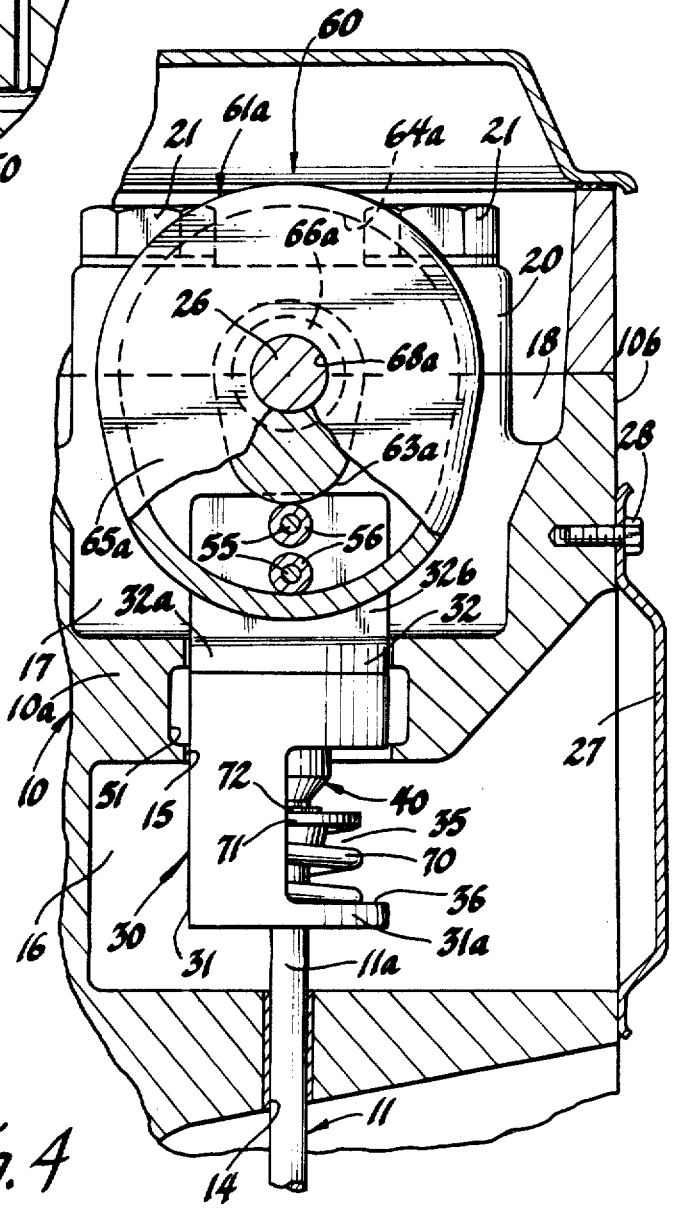

The cylinder head 10 between the valve stem guide bore 14 and the intermediate web portion 10*a*, is provided with a window cavity 16, of suitable size to permit access to the cam follower 30 and valve 11, this window cavity 16 being normally closed by a cover plate 27, fixed to the right hand side wall 10*b* of the cylinder head 10, with reference to FIGS. 2 and 4, as by screws 28, only one of which is shown, in a conventional manner.

In addition, the cylinder head 10 is provided with spaced apart cavities 17 for each of the cylinders, not shown, of the engine, each of these cavities 17 being of a size to rotatably receive an associate double cam, generally designated 60, fixed to an engine driven camshaft 26, and with suitably machined intermediate upstanding pads 18 to which bearing caps 20 may be suitably secured, as by machine screws 21 extending through apertures 20*a* in the bearing caps 20 for threaded engagement into the internally threaded bores 22 provided for this purpose in the pads 18 of the cylinder head 10.

Figure 3:
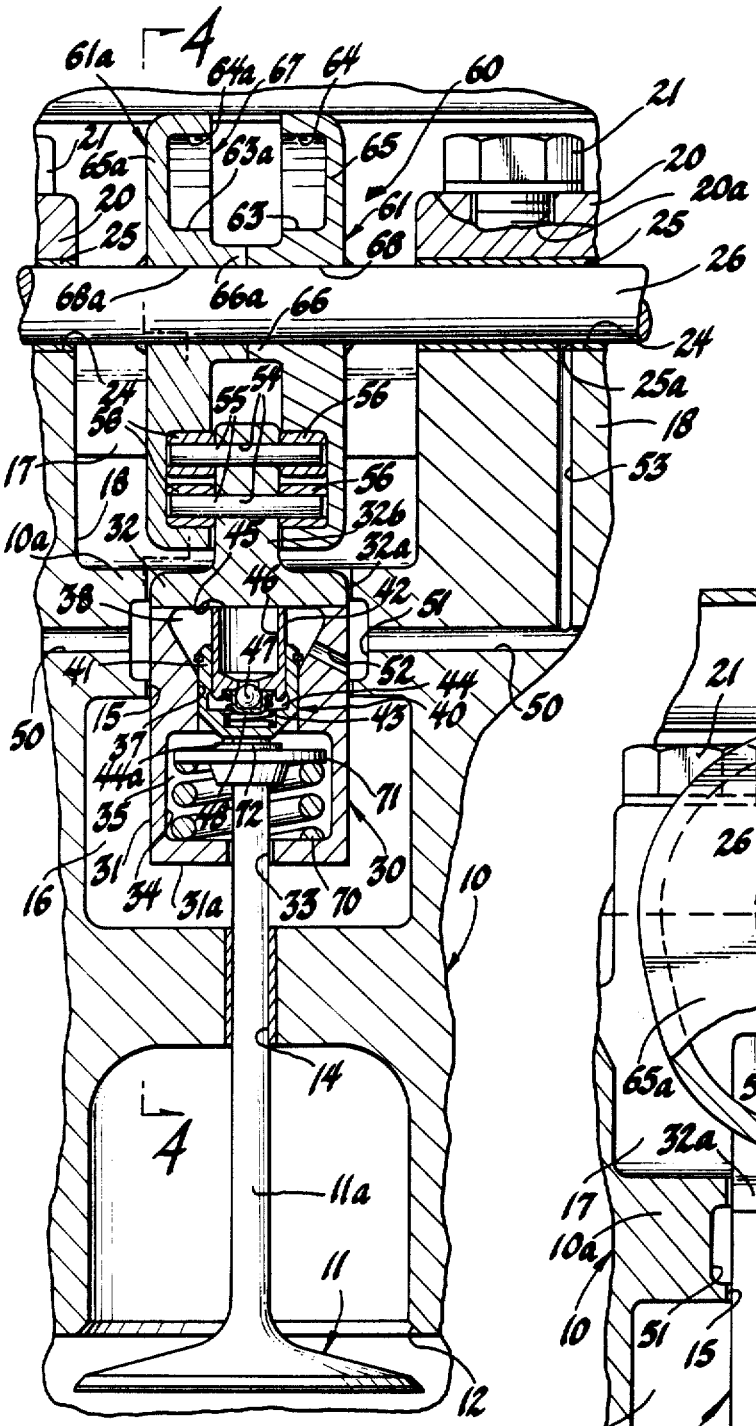
FIG. 3 is a cross-sectional view corresponding to FIG. 1 but with the associated elements shown in a valve open position; and, FIG. 4 is a transverse cross-sectional view of the assembly of FIG. 3 taken along line 4—4 of FIG. 3 showing the position of the elements in the valve open position.

In the construction illustrated and as best seen in FIGS. 1 and 3, the bearing caps 20 and the pad 18 are provided with longitudinal extending bores 24 of a size so that each bore receives a bearing 25 to rotatably support the camshaft 26 carrying the double cam 60.

The cam follower 30, preferably made of steel, includes, for ease of manufacturing, a two piece assembly that is comprised of a cylindrical lower follower body 31 with an outer wall of a suitable diameter to be slidably received in the follower guide bore 15 and an upper cam-follower member 32, these elements being suitably secured together as, for example, by electron beam or laser beam welding.

As best seen in FIGS. 1 and 3, the lower follower body 31, of cup-shaped configuration, is provided with a stepped through bore defining in order starting from its base wall 31*a*, a cylindrical lower wall 33 of a diameter to loosely receive the stem 11*a* of the associate poppet valve 11, a lower intermediate wall 34 defining a spring cavity 35 with a window 36 on one side thereof, as best seen in FIGS. 2 and 4, for access by an assembler to the spring cavity 35, an upper intermediate hub wall 37 of a diameter to slidably receive the body 41 of a hydraulic lash adjuster, generally designated 40, to be described hereinafter, and an upper enlarged diameter bore wall defining with the lower wall of the upper cam follower member 32 a hydraulic fluid reservoir 38.

In the construction illustrated, the hydraulic lash adjuster 40 which is of conventional construction and is preferably of the type disclosed in U.S. Pat. No.

3,509,858 Scheibe et al, includes a body 41 of upward presenting cup-shaped cylindrical configuration whose closed end 41*a* rests on the upper free end of the valve stem 11*a* which extends through the lower wall 33 into the spring cavity 35. A plunger 42 has a close sliding fit for reciprocation within the body 41, and is normally biased upwardly therein by a plunger spring 43 so that its upper end abuts against the bottom wall of the upper cam follower member 32. The plunger spring 43 also reacts against the closed end 41*a* of the body 41 to maintain it in abutment against the valve stem 11*a*. The lower end of the plunger 42 forms with the closed end of the body 41 a pressure chamber 44 and this chamber is supplied with hydraulic fluid, such as lubricating oil, within the reservoir 38 as via a passage 45 formed in the lower wall of the upper cam follower member 32 and a stepped axial passage 46 formed in the plunger 42. Flow of hydraulic fluid through the passage 46 into the pressure chamber is controlled by a one-way valve in the form of a ball 47 movably supported in an apertured valve cage 48, the latter being suitably held in position against the bottom of the plunger 42 as by the plunger spring 43.

As conventional, hydraulic fluid in the form of lubricating oil is supplied from the engine lubrication system via an oil gallery 50 and an annulus cavity 51 provided in the cylinder head 10 and a side port 52 in the lower follower body 31 to the reservoir 38. In addition, in the construction illustrated, the oil gallery 50 is also used to supply oil to each of the bearings 25 via a riser passage 53 and, for example, at least one radial port 25*a* provided in the associate bearing 25.

Referring now to the upper cam follower member 32 of cam follower 30, it includes a lower cylindrical base portion 32*a* conforming in shape to the lower follower body 31, with a narrow rectangular boss 32*b*, of a predetermined extent, extending upward from and centrally of the base portion 32*a*. The boss 32*b* is provided with two spaced apart through bores 54 each of a size to receive an associate stub shaft 55 extending therethrough whereby each of the stub shafts 55 are adapted to rotatably support a roller follower 56 on opposite ends thereof for operative engagement with the double cam 60.

For ease of manufacturing and to permit the assembly of the above-described elements therein, the double cam 60 is made in two mating pieces, that is, with a right hand portion 61 and a left hand portion 61*a*, with reference to FIGS. 1 and 3, of mirror-like configuration. Thus as shown, each portion 61 and 61*a* is provided with an internal or inner cam 63 and 63*a*, and an internal type external or outer cam 64 and 64*a*, that are similar in configuration to the profile of the inner cams 63, 63*a*, with an integral interconnecting flange 65 and 65*a*, respectively, connecting the outboard ends of the inner cams 63 and 63*a* to the respective outer cams 64 and 64*a*. In addition each inner cam 63 and 63*a* also has an associate integral hub 66 and 66*a*, respectively, on its inboard end so that when the right and left hand portion 61 and 61*a*, respectively, are positioned to have their hubs 66 and 66*a* in abutment against each other, a stepped groove or slot 67 is provided of suitable extent so as to receive the roller followers 56 and to loosely receive the boss 32*b* of the cam follower 30.

Also as illustrated, the right and left hand portions 61 and 61*a*, respectively, are provided with through bores 68 and 68*a*, respectively, to receive the straight portion of the camshaft 26 to which these portions are then suitably secured, as by welding. It should, however, be apparent that prior to such welding, the right and left hand portions 61 and 61*a*, respectively, are first loosely supported on the camshaft 26 in axial spaced apart relationship so as to receive the upper end elements associated with the cam follower 30 therebetween, after which the portions 61 and 61*a* can be moved toward each other to the position shown, as identified by suitable index marks, not shown, whereby to effect proper axial and angular alignment of these portions on the camshaft 26, and then they are fixed, as by welding to the camshaft 26.

It will be appreciated that due to production tolerances, a predetermined suitable clearance is provided between the lower roller followers 56 that are located so as to be, in effect, engaged by the associate outer cams 64, 64*a*.

It should also be appreciated that the double cam 60 and the roller followers 56 are lubricated in any desired suitable manner as, for example, by splash lubrication.

However, to prevent pump up of the hydraulic lash adjuster 40 and to insure proper seating and to retain such seating of the poppet valve 11, a spring 70, which is somewhat similar to a valve return spring, can be operative in the final closing movement of the poppet valve 11 to insure and maintain proper seating of this valve or alternatively can be further compressed to maintain the valve closed, as described hereinafter.

As shown, the spring 70 is preferably slightly compressed and is operatively located in the spring cavity 35 so as to loosely encircle an upper portion of the valve stem 11*a*, with one end thereof abutting the lower base wall 31*a* of the lower follower body 31 and having its upper end in abutment against a spring retainer 71 fixed by a retainer lock 72 to the valve stem 11*a* in a conventional manner well known in the art.

During engine operation, as the camshaft 26 is rotated, the roller followers 56 engaging the inner cams 63, 63*a* will operate to effect opening movement of the poppet valve 11 from the closed position shown in FIG. 1 to the open position shown in FIG. 3, via the hydraulic lash adjuster 40 in a conventional manner. However, upon continued rotation of the camshaft 26, the roller follower 56 engaging the outer cams 64, 64*a* will pull the cam follower 30 back up toward the position shown in FIGS. 1 and 2 and, via the force of spring 70 it will also move the poppet valve 11 upward toward the closed position.

Preferably, the configuration of the outer cams 64, 64*a* is such that the upward movement is such that the poppet valve 11 is moved, by these outer cams 64, 64*a* and the cam follower 30, to a valve closed position at which the valve engages the associate valve seat surrounding the port 12, and then continued further slight upward movement of the cam follower will compress the valve spring 70 so as to increase the upward bias force on the poppet valve 11 to assure that this valve will remain closed until the next valve opening cycle is initiated.

Alternatively, if due to manufacturing tolerances the outer cams 64, 64*a* are not operative, in the manner described hereinabove, to fully retract the poppet valve 11 to the closed position, as when these outer cams 64, 64*a* are in the position shown in FIGS. 1 and 2, then the previously biased spring 70 will be operative to effect final full closure of the poppet valve 11 and to maintain such closure.

While the invention has been described with reference to the structure disclosed herein, it is not confined to the specific details set forth, since it is apparent that modifications and changes can be made by those skilled in the art. For example, a self-contained hydraulic lash adjuster can be used in lieu of the hydraulic lash adjuster shown. This application is therefore intended to cover such modifications or changes as may come within the purposes of the improvements or scope of the following claims.

The embodiments of the invention in which an exclusive property or privilege is claimed are defined as follows:

1. A direct acting cam-valve assembly for an internal combustion engine having an engine block means defining a cylinder with a port and a valve with a valve stem reciprocably guided in said engine block means and located for axial movement in said port, a camshaft with a double cam rotatably supported by the engine block means in a position above and in spaced apart relationship to said valve, said double cam including therein an internal track means defining an cam means and an outermost cam means, a follower guide bore in said engine block means, a cam follower reciprocably journaled in said follower guide bore, first and second sets of roller followers spaced parallel to each other operatively connected adjacent to one end of said cam follower with said first set of said roller followers operatively engaging said innermost cam means and said second set of said roller followers operatively engaging said outermost cam means whereby said cam follower is reciprocated during rotation of said camshaft, the opposite end of said cam follower having a stepped bore therethrough defining in succession from its outboard end a cylinder lower wall to loosely receive a free end of said valve stem of said valve, a spring cavity and a hub wall, a hydraulic lash adjuster operatively positioned in said hub wall in position whereby one end thereof will abut against the free end of said valve stem, and a spring operatively positioned in said spring cavity and operatively connected to said valve stem to normally bias said valve in an axial direction toward said one end of said cam follower.

2. A direct acting cam-valve assembly for an internal combustion engine having an engine block means and that defining a cylinder and includes a cylinder head means with a port and a valve with a valve stem reciprocably guided in a stepped bore in said cylinder head means and located for axial movement in said port, a camshaft with a double cam means rotatably supported by the cylinder head means in a position above and in spaced apart relationship to said valve, said double cam means including therein an internal track means defining an cam means and an outermost cam means spaced parallel to each other to define a stepped slot, said stepped bore defining a follower guide bore in said cylinder head means with passage means in said cylinder head for supplying hydraulic fluid to said follower guide bore, a cam follower reciprocably journaled in said follower guide bore, first and second sets of roller followers operatively connected adjacent to the-end of said cam follower in spaced apart relationship to each other so as to extend through said stepped slot with said first set of said roller followers operatively engaging said innermost cam means and said second set of said roller followers operatively engaging said outermost cam means whereby said cam follower is reciprocated during rotation of said camshaft, the opposite end of said cam follower having a stepped bore therethrough defining in succession from is outboard end a cylinder lower wall to loosely receive a free end of said valve stem of said valve, a spring cavity and a hub wall, a hydraulic lash adjuster operatively positioned in said hub wall in position whereby one end thereof will abut against the free end of said valve stem, and a spring operatively positioned in said spring cavity and operatively connected to said valve stem to normally bias said valve in an axial direction toward said one end of said cam follower and against said one of said hydraulic lash adjuster whereby said valve is operatively connected to said cam follower for reciprocating movement therewith.

3. A direct acting cam-valve assembly for an internal combustion engine of the type having an engine block means defining a cylinder with a port and a valve with a valve stem reciprocably guided in a stepped bore in said engine block means and located for axial movement relative to said port, a camshaft with a double cam means rotatably supported by the engine block means in a position above and in spaced apart relationship to said valve, said double cam means including therein an internal track means defining an intermost cam means and an outermost cam means spaced parallel to each other and defining a stepped slot therebetween, a follower guide bore in said engine block means, a cam follower reciprocably journaled in said follower guide bore, first and second sets of roller followers operatively connected adjacent to one end of said cam follower extending through said stepped slot whereby said first set of said roller followers operatively engage said innermost cam means and said second set of said roller followers operatively engaging said outermost cam means whereby said cam follower is reciprocated during rotation of said camshaft, the opposite end of said cam follower having a stepped bore therethrough defining in succession from its outboard end a cylinder lower wall to loosely receive a free end of said valve stem of said valve, a spring cavity, a hub wall and a cavity for hydraulic fluid, a hydraulic lash adjuster operatively positioned in said hub wall in position whereby one end thereof will abut against the free end of said valve stem while its opposite end extends into said cavity so as to abut against a shoulder defined by the blind end of said stepped bore, and a spring operatively positioned in said spring cavity and operatively connected to said valve stem to normally bias said valve in an axial direction toward said one end of said cam follower and against said one end of said hydraulic lash adjuster.

* * * * *

UNITED STATES PATENT AND TRADEMARK OFFICE

CERTIFICATE OF CORRECTION

PATENT NO. : 4,711,202

DATED : December 8, 1987

INVENTOR(S) : Steven F. Baker

It is certified that error appears in the above-identified patent and that said Letters Patent is hereby corrected as shown below:

Column 5, line 22, after "an" insert -- innermost --.

Column 5, line 54, after "an" insert -- innermost --.

Signed and Sealed this

Fourteenth Day of June, 1988

*Attest:*

DONALD J. QUIGG

*Attesting Officer*

*Commissioner of Patents and Trademarks*